United States Patent [19]

Arnaud

[11] Patent Number: 4,479,478

[45] Date of Patent: Oct. 30, 1984

[54] DEVICE FOR CONTROLLING THE RECIRCULATION OF EXHAUST GASES IN INTERNAL COMBUSTION ENGINES

[75] Inventor: Henri Arnaud, La Ferte Alais, France

[73] Assignee: Regie Nationale des Usines Renault, Boulogne-Billancourt, France

[21] Appl. No.: 540,840

[22] Filed: Oct. 11, 1983

[30] Foreign Application Priority Data

Oct. 11, 1982 [FR] France ..... 82 16958

[51] Int. Cl.[3] ..... F02M 25/06

[52] U.S. Cl. ..... 123/571; 123/568

[58] Field of Search ..... 123/568, 571

[56] References Cited

U.S. PATENT DOCUMENTS

| | | | |
|---|---|---|---|
| 3,730,156 | 5/1973 | Sarto | 123/568 |
| 3,998,194 | 12/1976 | Berzlana | 123/568 |
| 4,106,467 | 8/1978 | Yamashita et al. | 123/571 X |
| 4,165,722 | 8/1979 | Aoyama | 123/571 |
| 4,325,378 | 4/1982 | Abe | 123/571 |
| 4,380,988 | 4/1983 | Otsuka et al. | 123/571 |

*Primary Examiner*—Wendell E. Burns

*Attorney, Agent, or Firm*—Oblon, Fisher, Spivak, McClelland & Maier

[57] ABSTRACT

A device is disclosed for controlling the recirculation of exhaust gas for an internal combustion engine 1 in which an air-fuel mixture intake pipe 2 and an exhaust pipe 3 are connected with each other by a recirculation circuit having a main valve 4 and connecting pipes 5 and 6. This valve 4 is controlled by the partial vacuum prevailing at the venturi V of the intake pipe 2 by a solenoid valve 14. According to the invention, this control device includes a control system 13 having an additive type pneumatic amplifier 17 that generates a partial vacuum signal for the control of this main valve 4 whose strength is greater than the value of partial vacuum at the nozzle 16 of the venturi throat V, with a constant value in a range of extended operation. Application is particularly to internal combustion engines equipped with a system for recirculation of exhaust gas.

9 Claims, 4 Drawing Figures

1
2
3
4
5
6
7
8
8a
8a'
8b
9
10
11
12
13
14
15
16
17
17a
17b
17c
18
19
20
21
22
23
24
25
26
27
28
50
V

DEVICE FOR CONTROLLING THE RECIRCULATION OF EXHAUST GASES IN INTERNAL COMBUSTION ENGINES

BACKGROUND OF THE INVENTION

1. Field of the Invention

The present invention relates to a device for controlling the recirculation of exhaust gases in an internal combustion engine.

2. Description of the Prior Art

It is well known to use devices for the recirculation of exhaust gases in internal combustion engines to reduce atmospheric pollution. A recirculation passage reintroduces the exhaust gases into the air-fuel mixture of the intake manifold of the engine so as to reduce the polluting emissions of nitrogen oxides.

A valve for controlling the recirculation is generally placed in the recirculation passage to control the recirculation flow in response to the vacuum created by the engine in the intake manifold.

To obtain a high rate of recirculation in the full range of engine operation, it has proven to be essential to adapt the rate of recirculation to the capacity of the engine to accept recirculated gases without reduced engine performance at low loads and without, consequently, increasing the emissions of hydrocarbons.

SUMMARY OF THE INVENTION

The invention has as its object to very simply and effectively achieve an adjustment of the rate of recirculation of exhaust gas as a function of the air flow and the load of the engine.

For this purpose, the invention proposes a device for controlling the recirculation of exhaust gas for an internal combustion engine of the type in which an air-fuel mixture intake manifold and an exhaust manifold are connected with each other by a recirculation circuit having a main valve and connecting pipes, this valve being controlled by a solenoid valve responsive to the partial vacuum prevailing in the intake manifold.

According to a first characteristic of the invention, this control device includes a control system having an additive type pneumatic amplifier that generates a partial vacuum signal for the control of the main valve, the signal strength being greater than the value of the partial vacuum at the nozzle of the venturi throat, and with a constant value in a range of extended operation. According to a second characteristic of the invention, said constant value corresponds to the reaction force of a spring housed in an upper chamber of this pneumatic amplifier, the spring being attached to the surface of a membrane of the amplifier. The above structure results in a recirculation control device of great simplicity and high efficiency, which is based on an additive amplification of a partial vacuum signal representative of the air flow admitted to the engine.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
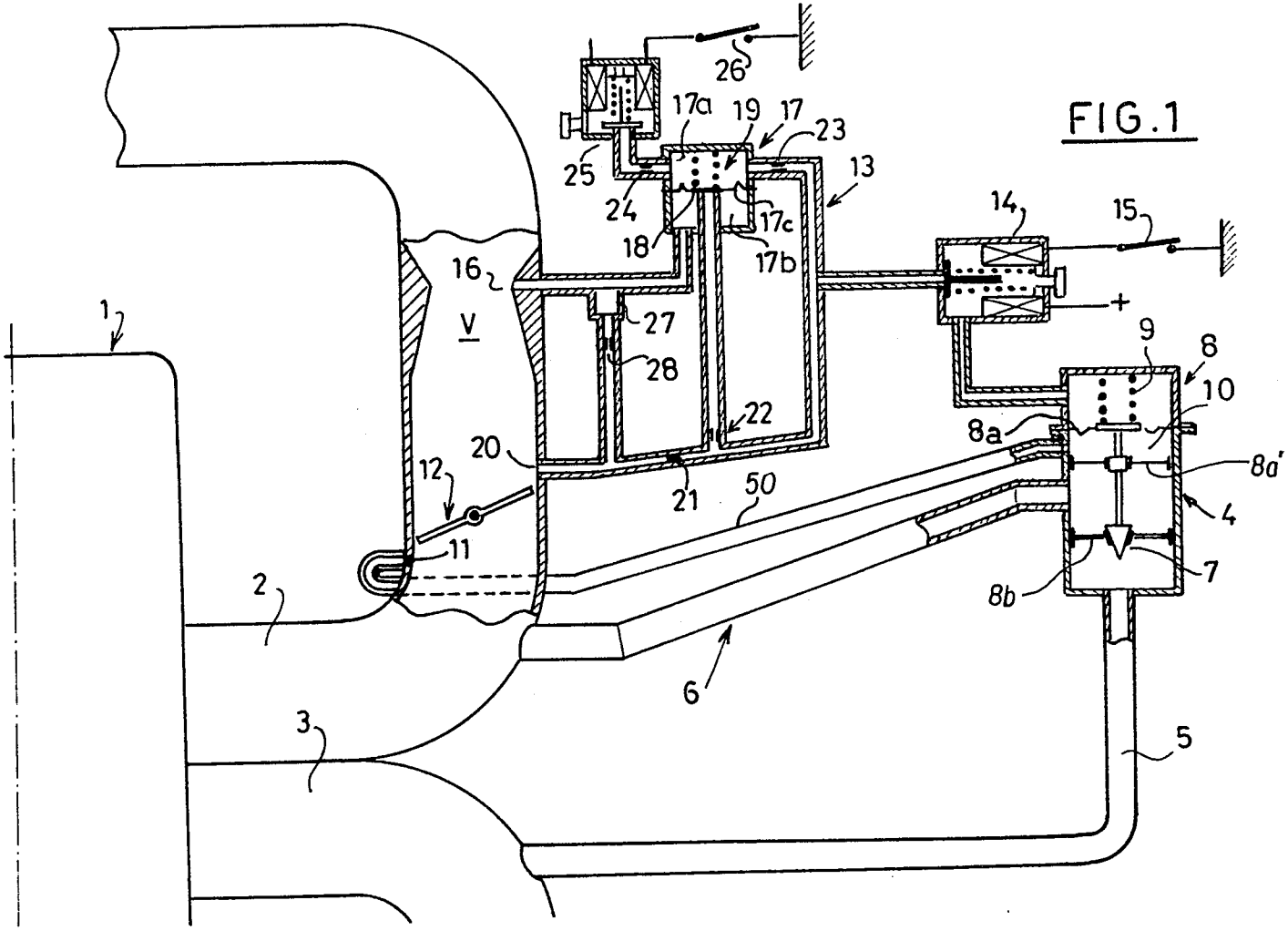
FIG. 1 is a schematic illustration of a preferred embodiment according to the invention.

As shown in FIG. 1, an internal combustion engine 1 has a air-fuel mixture intake manifold or pipe 2 and an exhaust manifold or pipe 3.

These pipes are connected with each other by a recirculation circuit for exhaust gas, including a main valve 4 and connecting pipes 5 and 6. Main valve 4 is in the form of a control valve 7 operated by a pressure cylinder 8 including a diaphragm **8*a* acting against the force of a spring 9. This cylinder 8 has a guide 8*a* for guiding movement of the valve 7, a lower, airtight chamber 10 connected, via a pipe 50 to an opening 11 of intake pipe 2 at a point downstream from the lower wing of a butterfly valve 12 when the latter is in the idling position and a valve seat 8*b***.

The device for controlling the recirculation of exhaust gas according to the invention includes a control system 13 associated with a solenoid valve 14 controlled by an electric switch 15 in the solenoid circuit. This control system 13 includes an additive type pneumatic amplifier 17 having an upper chamber **17*a* and a lower chamber 17*b*, separated by a diaphragm 17*c* which carries a valve 18 biased in a closed position by a spring 19**.

Spring 19 is housed in upper chamber **17*a* of amplifier 17 and lower chamber 17*b* of amplifier 17 is connected directly to nozzle 16 at venturi throat V of intake pipe 2. The partial vacuum for controlling the main valve 4, which is applied on the upper face of diaphragm 17*c* of pneumatic amplifier 17 is the sum of the partial vacuum prevailing at an opening 20 situated upstream from the upper wing of the butterfly when valve 12 is at idling, via a restriction 21, and the partial vacuum prevailing at nozzle 16, via valve 18 and a restriction 22. A supplementary device consisting of restriction 23, 24, a solenoid valve 25 and an electrical switch 26 of the solenoid can be connected to upper chamber 17*a* of pneumatic amplifier 17 to modify the equilibrium point of diaphragm 17*c*** of this pneumatic amplifier.

In the case where this device for controlling the recirculation of exhaust gas is applied to an engine equipped with a carburetor, an auxiliary device formed by a low capacity reservoir 27 and a restriction 28 can also be added to pneumatic amplifier 17 between nozzle 16 and lower chamber **17*b* of amplifier 17**.

Figure 2:
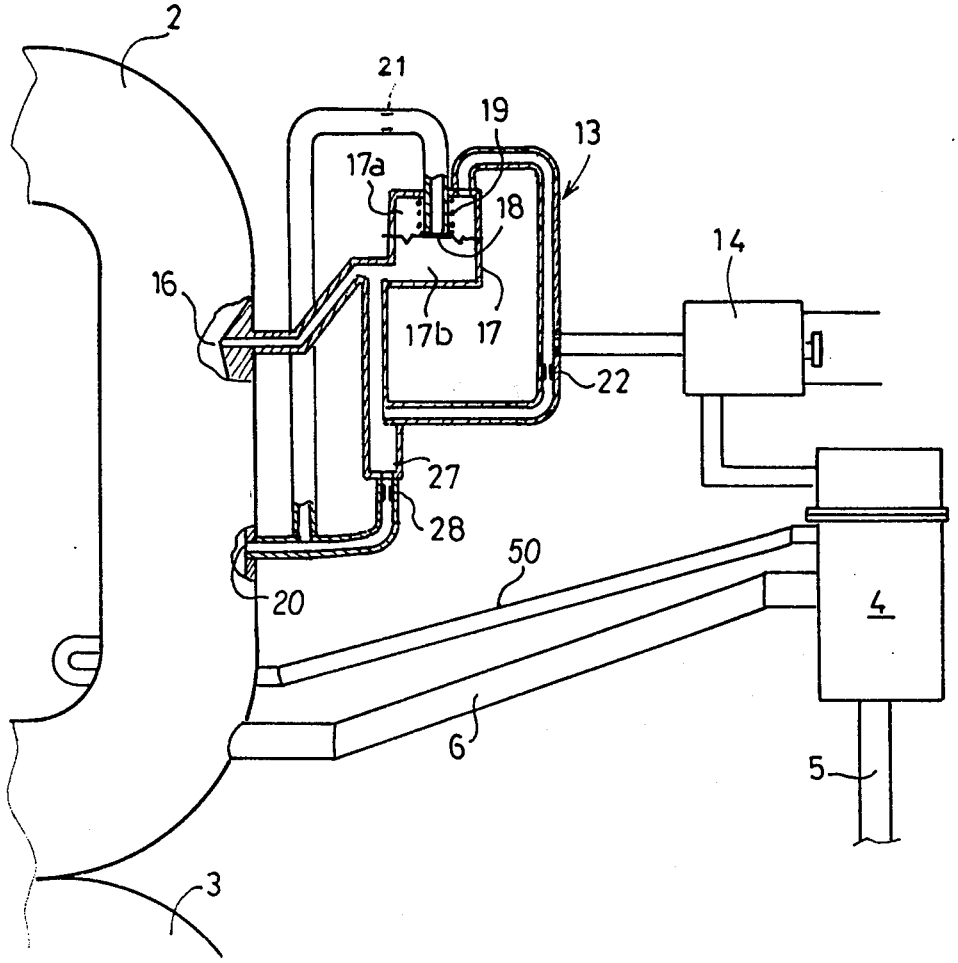
FIG. 2 is a schematic illustration of a second embodiment of the invention.

The variant shown in FIG. 2 differs from the previously described embodiment by the control system which, however, remains based on the same principle. A valve 18 of a pneumatic amplifier 17, in contrast with valve 18 shown in FIG. 1, is pushed open by a spring 19 housed in an upper chamber **17*a*** of this amplifier.

Figure 3:
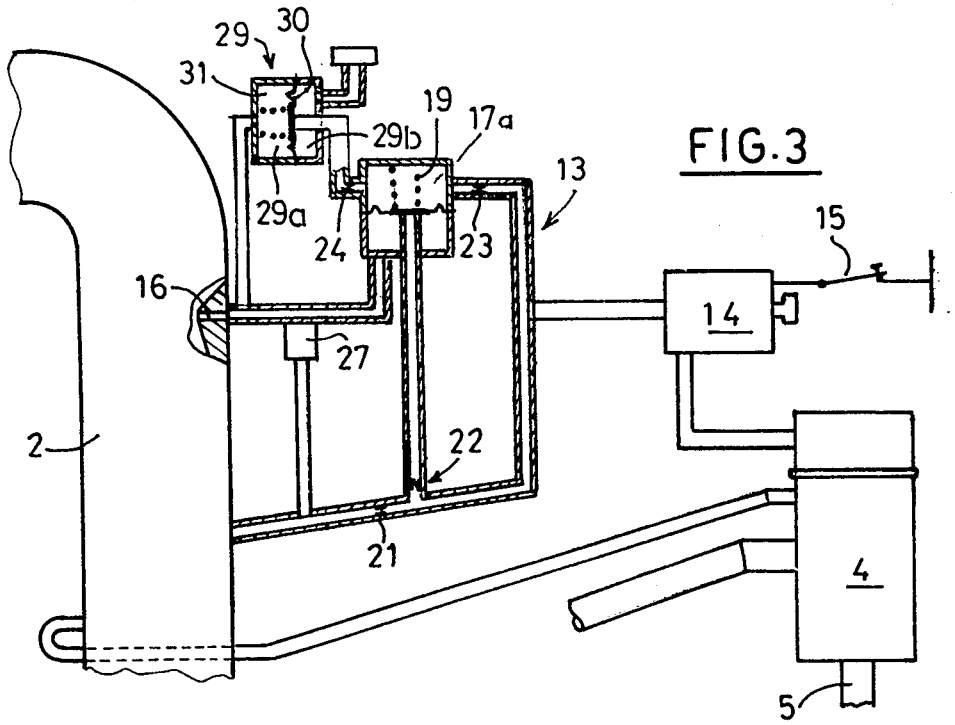
FIG. 3 is a schematic illustration of a third embodiment of the invention.

The variant shown in FIG. 3 differs from the embodiment previously described according to FIG. 1 only in the device for correcting the control which, however, remains based on the same principle; solenoid valve 25 and contactor 26 of FIG. 1 are replaced by a manometric valve 29 having a valve element 30 driven in the opening direction by the partial vacuum prevailing at nozzle 16, against the action of spring 31.

Figure 4:
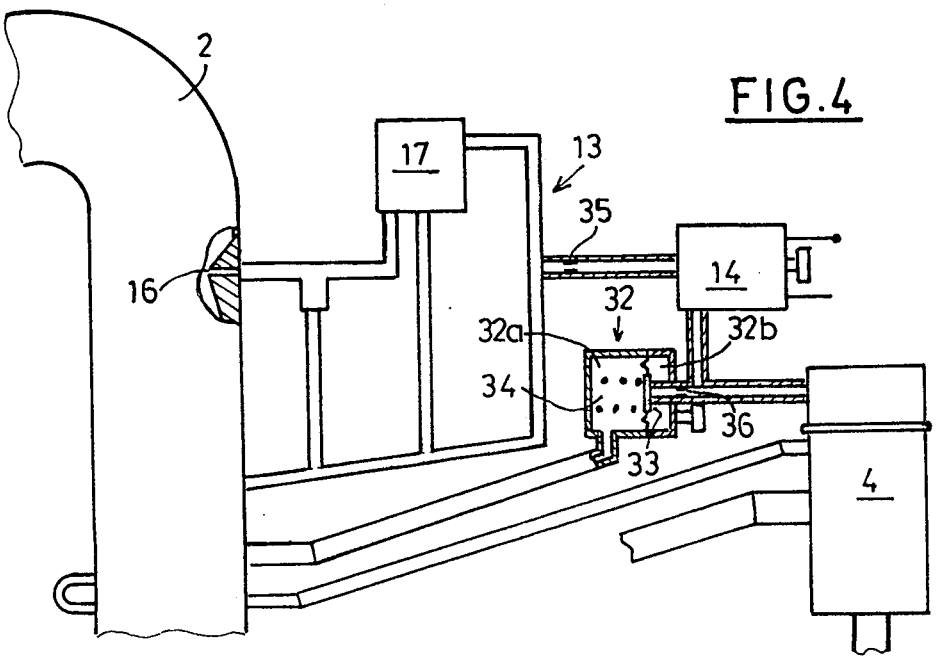
FIG. 4 is a schematic illustration of a fourth embodiment of the invention.

The variant shown in FIG. 4 differs from the embodiment described above according to FIG. 3 by the device for correcting the partial control vacuum which acts on the recirculation valve by decreasing the control signal at low loads, while the device corresponding to FIG. 3 acts by increasing the control signal at heavy loads; to do this, manometric valve 29 and restrictions 23, 24 of FIG. 3 are replaced with a manometric valve 32, having a valve element 33 driven in the opening direction by the partial vacuum prevailing in the intake manifold against the action of a spring 34, and by the restrictions 35 and 36.

The device for controlling the recirculation of exhaust gas previously described and illustrated in FIG. 1 operates in the following manner:

The main recirculation valve 4 is driven in the opening direction by a partial control vacuum signal delivered by control system 13 due to the solenoid valve 14 controlled by the switch 15 being activated as a function, for example, of the temperature of the cooling liquid and/or as a function of a transmission ratio. The partial control vacuum is generated from the partial vacuum which prevails at opening 20 through the restriction 21. This partial vacuum is weakened by leakage from the partial vacuum which prevails at nozzle 16 through valve element 18 and restriction 22. The sum of this partial control vacuum is applied on the upper face of diaphragm 17*c* via restriction 23 and opposes the sum of the partial vacuum prevailing at nozzle 16, representative of the air flow admitted to the engine, and the force of spring 19, both of which are applied on the lower face of diaphragm 17*c*.

The partial control vacuum is therefore equal to the partial vacuum at nozzle 16 increased by a constant value corresponding to the reaction force of spring 19 attached to diaphragm 17*c* of pneumatic amplifier 17.

The supplementary device, consisting of restrictions 23 and 24 and the solenoid valve 25, makes it possible to modify the equilibrium of membrane 17*c* by use of a vacuum leak in upper chamber 17*a* of pneumatic amplifier 17, solenoid valve 25 being actuacted by switch 26; this switch acts in response to and additional parameters to increase the partial vacuum for controlling main valve 4, for example, at the beginning of transitory acceleration phases.

This invention, therefore, offers a simple and effective device for controlling a main recirculation valve 4, which is based on an additive amplification of a partial vacuum signal representative of the air flow admitted to the engine.

The arrangement of the pressure cylinder 8 of main valve 4 in that it has a lower airtight chamber 10 makes it possible to eliminate leaks due to the guiding of the support rod of valve 7 and to assure a better airtightness at valve 7 by reinforcing the action of spring 9; moreover, in the case of supercharged engines, this arrangement makes is possible to compensate for the supercharging pressure by allowing the opening of recirculation valve 4 even in the supercharging phase.

In the case where the control device of the invention is applied to engines equipped with carburetors, the auxiliary device consisting of low capacity reservoir 27 and restriction 28 makes it possible to avoid an accumulation of fuel in amplifier 17 because of the existence of gas circulation from the opening at nozzle 16 toward opening 20 (FIG. 1).

According to the second embodiment shown in FIG. 2, valve element 18 of pneumatic amplifier 17 controls the intervention of the partial vacuum that prevails at opening 20 situated upstream from the upper wing of butterfly valve 12 at idling.

According to this embodiment, when the partial vacuum at nozzle 16 becomes greater than the partial vacuum at butterfly valve 12, the signal for controlling recirculation valve 4 takes an intermediate value which is a function of spring 19 as well as restrictions 21 and 22, whereas, according to the first embodiment, the partial vacuum at the butterfly valve 12 represents the maximum value in the entire range of operation.

According to the embodiment shown in FIG. 3, manometric valve 29 controls the intervention of a leak from the atmosphere to chamber 17*a* of amplifier 17, through calibration 24, when the partial vacuum at the nozzle 16 exceeds a predetermined level, having as a consequence an increase of the signal for opening recirculation valve 4.

According to the embodiment shown in FIG. 4, manometric valve 32 controls the intervention of a leak from the atmosphere in the circuit for controlling recirculation valve 4 through restriction 36 when the partial vacuum at the intake manifold exceeds a predetermined level, having a consequence of decreasing the opening signal at low loads, without perceptibly affecting the control stage protected by restriction 35.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In an internal combustion engine having an intake pipe including a venturi throat, an exhaust pipe, a recirculation circuit connected between said intake and exhaust pipes, a main valve in said recirculation circuit and a first solenoid valve connected to said main valve, a device for controlling recirculation of exhaust gas through said recirculation circuit, said device comprising an additive type pneumatic amplifier including:

first means for sensing a partial vacuum at said venturi throat;

means for developing a pneumatic vacuum signal greater than said partial vacuum by a constant value over an extended engine operation range; and means for delivering this signal to said first solenoid valve for controlling said main valve.

2. The device of claim 1 wherein said means for developing a pneumatic signal includes:

a housing having an internal diaphragm dividing said housing into first and second chambers; and a spring in said first chamber and attached to said diaphragm whereby said constant value corresponds to the force of said spring.

3. The device of claim 2 wherein said second chamber is connected to said first means for sensing.

4. The device of claim 3 including:

second means for sensing a partial vacuum in said intake pipe at a position downstream from said venturi throat;

a first conduit, including a first restriction, connecting said second means for sensing with said means for delivering;

a second conduit, including a second restriction, connected between said first conduit and said second chamber, said second conduit being closed when said diaphragm is biased in a first position by said spring; and a third conduit, including a third restriction, connected between said first conduit and said first chamber, whereby said means for delivering receives from said means for developing, a signal corresponding to the sum of signals from said first and second conduits, when said diaphragm moves from said first position.

5. The device of claim 4 including a supplementary device comprising:

a fourth conduit, including a fourth restriction, connecting said first chamber to a source of atmospheric pressure;

a second solenoid valve in said fourth conduit for selectively closing said fourth conduit; and means for controlling said second solenoid valve.

6. The device of claim 4 including a fifth conduit connected between said first conduit and said first means for sensing, said fifth conduit including a reservoir and a fifth restriction.

7. The device of claim 3 including:

second means for sensing a partial vacuum in said intake pipe at a position downstream from said venturi throat;

a sixth conduit connecting said third means for sensing with said means for delivering;

a seventh conduit connected between said sixth conduit and said first chamber, said seventh conduit being open when said diaphragm is biased in said first position by said spring.

8. The device of claim 4 including a supplementary device comprising:

an eighth conduit connecting said second chamber to a source of atmospheric pressure;

a manometric valve in said eighth conduit, said manomertic valve being openable in response to a signal from said first means for sensing.

9. The device of claim 4 including a supplementary device comprising a manometric valve connected between said main valve and said first solenoid valve, said manometric valve being openable in response to a signal from said first means for sensing.

* * * * *